US005186365A

United States Patent [19]

Nolte

[11] Patent Number: 5,186,365

[45] Date of Patent: Feb. 16, 1993

[54] FITTING FOR EMPTYING A CONTAINER

[75] Inventor: Paul A. Nolte, Memphis, Tenn.

[73] Assignee: Ingersoll-Dresser Pump Company, Liberty Corner, N.J.

[21] Appl. No.: 763,349

[22] Filed: Sep. 20, 1991

[51] Int. Cl.[5] ..... B67B 5/00

[52] U.S. Cl. ..... 222/153; 222/402.19; 222/464; 137/320; 220/203

[58] Field of Search ..... 222/153, 382, 464, 402.19, 222/545; 137/320; 220/203, 265

[56] References Cited

U.S. PATENT DOCUMENTS

| | | | |
|---|---|---|---|
| 2,344,005 | 3/1944 | Sundholm | 222/382 |
| 4,775,079 | 10/1988 | Grothoff | 222/402.19 X |
| 4,949,878 | 8/1990 | Jacobi | 222/382 |

OTHER PUBLICATIONS

"Finally A Container Refilling Solution" *Fill Guard Systems*, Farmchem Corp.; Floyd, Iowa 50435, brochures.

*Primary Examiner*—Gregory L. Huson

*Attorney, Agent, or Firm*—Michael H. Minns

[57] ABSTRACT

A fitting for dispensing liquid from a container, including a housing for mounting within an opening of the container, a one-way valve within the housing for allowing liquid to only flow outward from the container, and a first drain hole through the housing wall. One of two selected tubes is inserted into the bottom open end of the housing: either a first tube with a solid cylindrical wall blocking the first drain hole, with a telescoping dip tube attached, or a second tube with a second drain hole through its cylindrical wall for alignment with the first drain hole. When the first tube is selected, liquid may be pumped from the container. When the second tube is selected, the container may be inverted and liquid may empty by gravity. The first and second drain holes allow residual liquid to be drained from within the container. A tamper evident wire seal may attach the housing to the container, preventing removal therefrom. A cap, attached by a strap to the housing, can seal the outer opening of the housing. The dip tube attached to the first tube may be of various lengths or diameters.

16 Claims, 3 Drawing Sheets

FITTING FOR EMPTYING A CONTAINER

BACKGROUND OF THE INVENTION

This invention relates generally to fittings for use in dispensing liquid from containers and more particularly to valved fittings allowing only one-way dispensing of liquid from containers.

It is common in the field of liquid chemicals to sell such liquids in reusable containers. Such containers typically will have one or more threaded openings for receipt of a tamper-evident fitting, and the fitting may have a one-way valve therein for preventing the user of the container from contaminating the liquid therein, while still allowing removal of liquid from the container. Fittings are known which allow attachment of a "dip tube" extending down into the container from the fitting, and typically a hose will be attached to an opening on the fitting for pumping liquid from the container, through the "dip tube" and fitting, to a remote point of application. This method of liquid extraction from the container inevitably leaves a small residual amount of liquid within the container.

Other methods of extracting liquid from a container are also known, the most common being to place a fitting on the side or bottom of a container and using the forces of gravity or pressure within the container to drain liquid from the container through the fitting. If a fitting on the bottom of the container extends any substantial distance into the container, a residual amount of liquid will not drain from the container.

Containers of liquid also are often stacked, one upon another, for shipment or storage. Such containers typically have a lip or sidewall extending above the top of the container, thereby protecting any upwardly extending necked opening from damage during shipment while the containers are stacked. It would be highly undesirable if a fitting which is placed in the necked opening of the container during shipment, together with any cap closing the fitting, were not of a "low profile" design and prevented the stacking of containers during shipment or storage.

Additionally, while it might be possible to design a fitting which solved only one of these problems, it would be undesirable if separate and different fittings were required for each particular end-use of the container, i.e., one type of fitting for use with a "dip tube", and another type for use in applications which use the forces of gravity to empty an inverted container. It is also highly desirable that any such fitting be capable of a high flow rate of liquid therethrough for rapid dispensing of liquid from the container.

The foregoing illustrates limitations known to exist in present container fittings with one-way valves. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fitting for use in dispensing liquid from a container, said fitting comprising: a housing having open upper and lower ends and a housing wall defining a passageway communicating the open upper end with the open lower end, said housing including means for mounting the housing in an opening through a wall of the container with the open upper end of the housing extending to the outside of the container and the open lower end of the housing in communication with the interior of the container; said fitting further comprising one-way valve means disposed therein for blocking flow of fluid through the housing in a direction towards the open lower end and permitting flow of fluid in the opposite direction towards the open upper end, and drain hole means through the housing wall in communication with both the interior of the container and the passageway for draining the interior of the container through the passageway.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
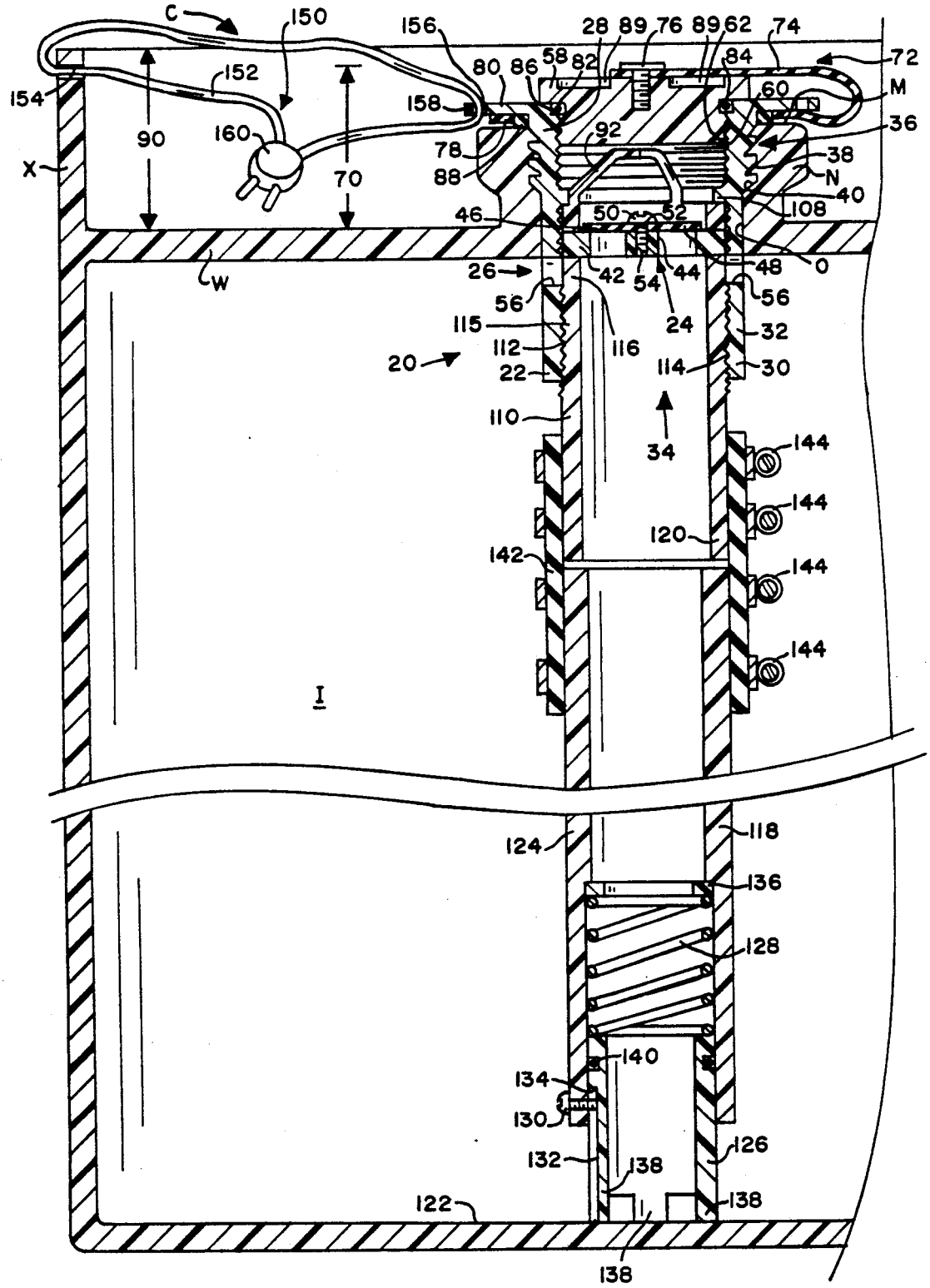
FIG. 1 is a sectional view taken through a diameter of an embodiment of the present invention, shown attached to a container, with an attached cap as well as a dip tube extending into the container.

Referring now to the drawings, FIG. 1 illustrates the fitting 20 of the present invention mounted within an opening O of a container C. Container C has a container wall W through which opening O penetrates, thereby communicating the outside or exterior of container C with the interior I of container C. Typically, container C will be filled with a liquid such as a chemical, and will be vented through a vent opening, not shown, in the well-known manner.

Fitting 20 is seen to comprise a housing 22, one-way valve means 24 disposed within housing 22 for blocking the flow of liquid inwardly through housing 22 and for permitting the flow of liquid outwardly through housing 22 in a manner hereinafter described, and first drain hole means 26. Housing 22 has an open upper end 28, an open lower end 30, and a housing wall 32 defining a passageway 34 communicating open upper end 28 with open lower end 30. Unless otherwise indicated, all parts of housing 22 are preferably of plastic to reduce interaction with and corrosion by chemicals that might be within container C.

Housing 22 also includes means 36 for mounting housing 22 within opening O, with open upper end 28 extending to the outside of container C and with open lower end 30 in communication with interior I of container C in a manner that will now be apparent. Preferably, means 36 for mounting housing 22 will be externally threaded portion 38 of housing 22 for threaded mating with internally threaded portion 40 of opening 0. Typically, portions 38 and 40 will be two inch "buttress threads," but it shall be understood that portion 38 may also be well-known "NPT" threads for mating with similar "NPT" threads found on some containers.

Figure 2:
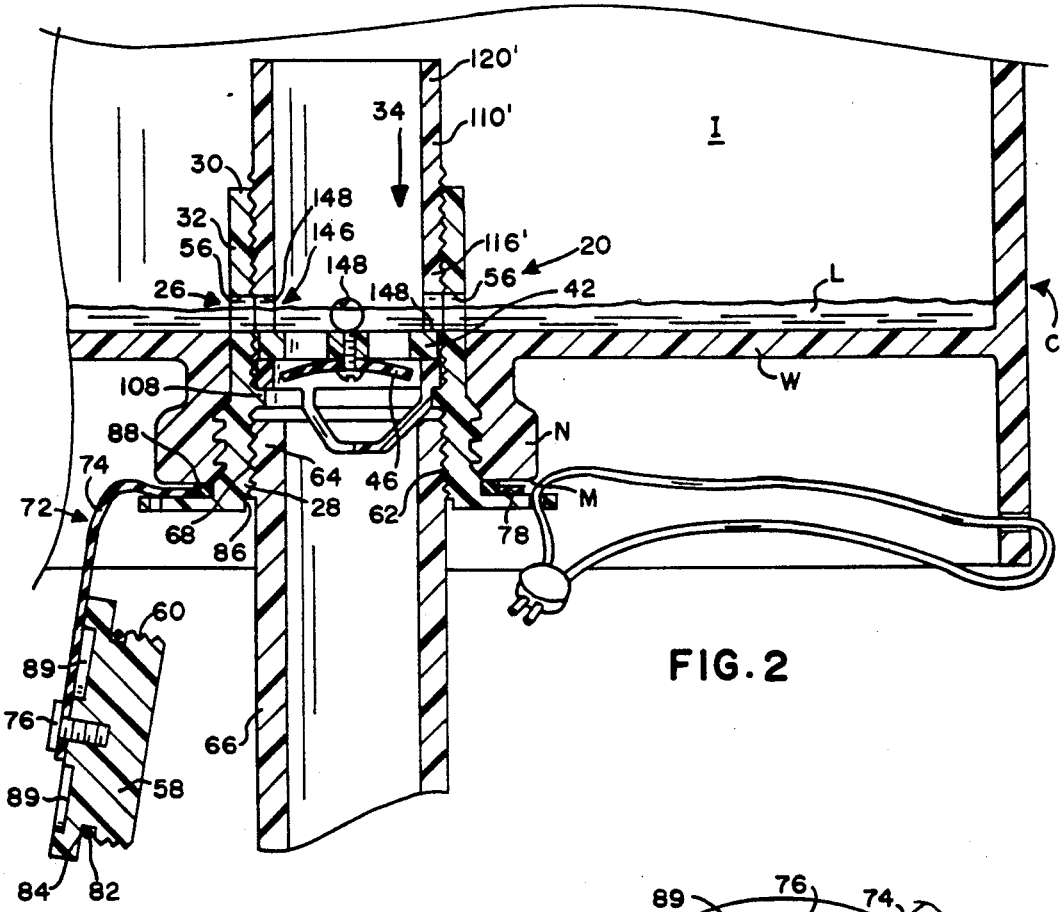
FIG. 2 is another sectional view of the present invention on an inverted container, with the cap removed, showing operation of the first and second hole means to drain the container.
Figure 3:
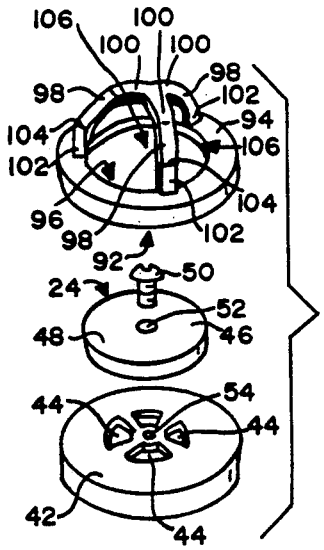
FIG. 3 is an exploded perspective view showing the guard means and component parts of the valve means removed from the present invention.

One-way valve means 24, disposed within housing 22, is shown in FIGS. 1-3. Valve means 24 includes a valve body 42 having one or more through passages 44 for the passage of liquid, and includes means, such as valve flapper 46, for selectively and unidirectionally sealing passages 44. In the preferred embodiment, valve flapper 46 is a flexible circular rubber disk 48 secured to valve body 42 by securing means such as screw 50 passing through a hole 52 in disk 48 into threaded hole 54 in valve body 42. FIG. 2 shows valve means 24 allowing liquid to pass through housing 22, here shown inverted for reasons hereinafter described, in a direction from end 30 to end 28, with flapper 46 being urged away from valve body 42 by the passage of liquid through passages 44, in a manner now well understood by those skilled in the art. FIG. 1 shows the resilience of disk 48 causing disk 48 to tend back toward housing body 42. It will be understood that, as liquid attempts to flow from end 28 to end 30, i.e., back into the interior I of container C from the outside, that flapper 46 will be forced against passages 44, blocking them and preventing the flow of liquid into interior I.

FIG. 2 also shows first drain hole means 26 through housing wall 32 in communication with the interior I of container C and also in communication with passageway 34 for draining liquid L from interior I through passageway 34. Preferably, drain hole means 26 includes one or more holes or openings 56 through housing wall 32.

Figure 4:
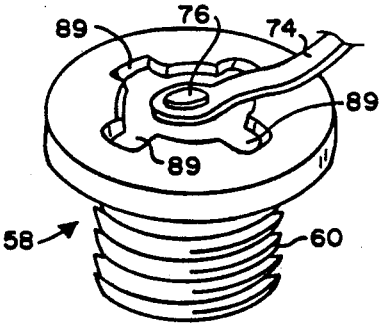
FIG. 4 is a perspective view of the fitting cap of the present invention.

FIGS. 1, 2, and 4 show a cap 58 of the present invention for sealing open upper end 28 of housing 22, having external threads 60 for threaded and mating engagement with similar sized internal threads 62 within open upper end 28 of housing 22. Cap 58 may be selectively threadedly received into upper end 28, for sealing closure therewith, or may be removed as shown in FIG. 2 to allow threaded receipt by open upper end 28 of an end 64 of a fitting pipe 66 having external threads 68 of the same size as threads 60 of cap 58. It shall be understood that threaded open end 28 may be appropriately sized for direct receipt of a specified size of pipe 66, allowing the use therewith without requiring the placement of an adaptor within open end 28 that might otherwise increase the total height 70 of the invention above wall W of container C and thereby prevent the stacking of containers C upon one another.

Cap 58 also may have strap means 72 for attaching cap 58 to housing 22. Strap means 72 preferably includes a rubber strap 74 attached to cap 58 by rivet 76, and includes a circular ring portion 78 through which housing 22 may be inserted. Housing 22 preferably has a lip 80 extending radially outwardly from upper end 28 for entrapment of ring portion 78 therebeneath when housing 22 is mounted within opening O, thereby preventing the loss or complete removal of cap 58 from housing 22 in a manner that will now be apparent. Cap 58 also has an "O"-ring 82 recessed in a channel 84 for sealing cap 58 to shoulder 86 of upper end 28. Similarly, a rubber ring gasket 88 may be placed beneath lip 80 of housing 22 for sealing engagement with mouth M of opening O. Preferably, as shown in FIG. 4, cap 58 has a multiplicity of recesses 89 for receipt of a tool to facilitate the tightening to and untightening from of cap 58 with respect to housing 22.

Container C also typically has a well-known chime or lip X extending a height 90 above wall W for protecting neck N, which forms the upper part of opening O, when containers C are stacked one on top of another. It is a feature of the present invention to have a low "stacking height", i.e., that the height 70 of cap 58 and strap means 72, including rivet 76, be as low as possible, below the height 90 of lip X, thereby allowing containers C to be stacked one on top of another.

Fitting 20 may also include guard means 92 within passageway 34 of housing 22, above valve means 24, see FIG. 1, for preventing tampering with valve means 24 through open upper end 28. If guard means 92 were not present, valve flapper 46 might be manually lifted from valve body 42, thereby allowing liquid to flow back into container C and defeating the one-way flow otherwise enforced by valve means 24. Referring to FIG. 3, guard means 92 preferably includes a base ring 94 having an opening 96 therethrough, and also includes a plurality of fingers 98 each respectively having upper ends 100 and lower ends 102, lower ends 102 being respectively fixedly attached to base ring 94, with fingers 98 extending upwardly and inwardly from base ring 94 towards one another and being fixedly joined together at upper ends 100. Fingers 98 are seen to be spaced apart along major portions 104 of the lengths thereof to provide openings 106 for the flow of liquid therethrough. Preferably, guard means 92 is inserted through lower end 32 of housing 22 for resting against a shoulder 108 therein, shown in FIG. 1, thereby preventing the removal of guard means 92 through opening 28 as will now be apparent.

Referring now to FIG. 1, a tube 110 may be removably received onto lower end 30, preferably by external threads 112 which threadedly engage with internal threads 114 within open lower end 30. Tube 110 is seen to removably secure valve means 24 within housing 22, such as against guard means 92 resting against shoulder 108, and preventing the removal of valve means 24 therefrom unless tube 110 is also removed. Valve means 24 thus may be removed from housing 22 for cleaning or repair, as desired, or be secured for use therein by tube 110. If removal of valve means 24 were not required, valve body 42 could be secured within housing 22 by ultrasonic welding of valve body 42 to housing 22 or by using a soldering iron to "stake" valve body 42 to housing 22 in a manner well-known to those skilled in the art.

Tube 110 has an upper portion 115 including a solid cylindrical wall 116 extending into open end 30 and blocking the flow of liquid through drain hole means 26, and has dip tube means 118 fixedly attached to a lower portion 120 thereof and extending to a position adjacent the lowermost portion 122 of container C for permitting pumping of liquid from the interior I of container C.

Dip tube means 118 may include a dip tube body 124 and a spring-loaded telescoping portion 126, biased downwardly by spring 128 and retained by screw 130 extending into channel 132 of telescoping portion 126 and by shoulder 134 of telescoping portion 126. Spring 128 preferably abuts against ring 136 within tube body 124, and forces spaced apart finger members 138 of telescoping portion 126 against lowermost portion 122 of container C. Also, telescoping portion 126 is preferably sealed to dip tube body 124 by an "O"-ring 140, in a manner that will now be apparent, for allowing the pumping excavation of liquid from within container C through fitting 20. Dip tube means 118 is preferably attached to the lower portion 120 of tube 110 using rubber sleeve 142 secured to tube 110 and dip tube means 118 by clamps 144 in a manner that will now be apparent. It shall be understood that various lengths of dip tube means 118 may be used, as required, with various sizes of container C.

When tube 110 with solid cylindrical wall 116 is removably received within lower end 30 of housing 22 with solid cylindrical tube wall 116 blocking drain hole means 26 and dip tube 118 is attached to tube 110, fitting 20 installed on container C shall be understood to be in a pumping condition for allowing liquid within the interior I of container C to be pumped therefrom through opening 28 of fitting 20, by means such as a fitting pipe 66 attached to a remote pump, in a manner well-known to those skilled in the art.

Alternately, tube 110 may be selected to be a different tube, designated as tube 110' shown in FIG. 2, including a cylindrical tube wall 116' and second drain hole means 146 for draining the interior I of container C by gravity through first drain hole means 26, second drain hole means 146, and passageway 34 within housing 22 when second drain hole means 146 is in alignment with first drain hole means 26. Second drain hole means 146 is preferably one or more holes 148 for alignment with first drain hole means 26, and it shall be understood that holes 148 may be oblong to reduce the criticality of alignment with first drain hole means 26, or the end of tube 110, may be formed to have finger members similar to finger members 138 of telescoping dip tube portion 126, also for reducing the criticality of alignment between first drain hole means 26 and second drain hole means 146.

As with tube 110, it shall be understood that tube 110' is removably received in end 30 of housing 22 for removably holding valve means 24 therein in a manner similar to that previously described. First and second drain hole means 26, 146 are preferably disposed in a position adjacent wall W of container C, thereby allowing the substantially complete draining of liquid L from the interior I of inverted container C when in a gravity drain condition as shown in FIG. 2 in a manner that will now be apparent. Were first and second drain hole means 26, 146 not present, liquid L would not otherwise drain below end 120', remote from housing 22, of tube 110'. It shall be understood that tube 110' preferably extends beyond end 30 of housing 22 for ease of removal therefrom by merely gripping end 120 and turning. While tube 110' could extend no further than end 30, such a construction would make removal of tube 110' more difficult, and might require a special tool such as a keyed wrench for mating with the interior of tube 110'.

Figure 5:
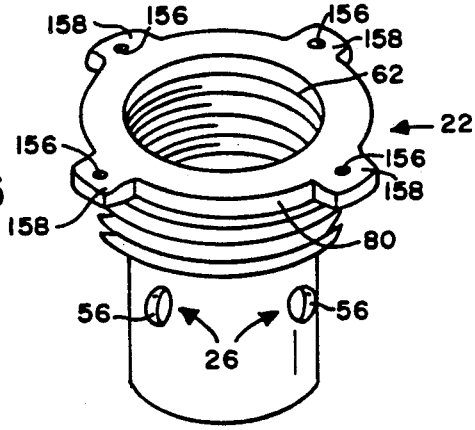
FIG. 5 is a perspective view of the housing of the present invention.

Referring to FIGS. 1 and 5, fitting 20 may also include tamper resistant lock means 150 attaching housing 22 to container C for preventing unwanted removal of housing 22 from container C. Preferably, lock means 150 is of the well-known leaded wire type as illustrated, and comprising a wire 152 threaded through hole 154 in lip X and also threaded through one of holes 156 provided in tabs 158 of housing 22, with both ends of wire 152 passing through and being sealed in a piece of lead 160 in a manner well-known to those skilled in the art. Alternately, if desired, a so-called "wire tie," well-known to those skilled in the art, can be inserted through holes 154 and 156 in a similar way and secured in a manner that will now be apparent. When secured by lock means 150, housing 22 cannot be substantially unscrewed from opening 0, so that any removal of housing 22 will be evidenced by breakage of lock means 150 in a manner that will now be understood by those skilled in the art.

Figure 6:
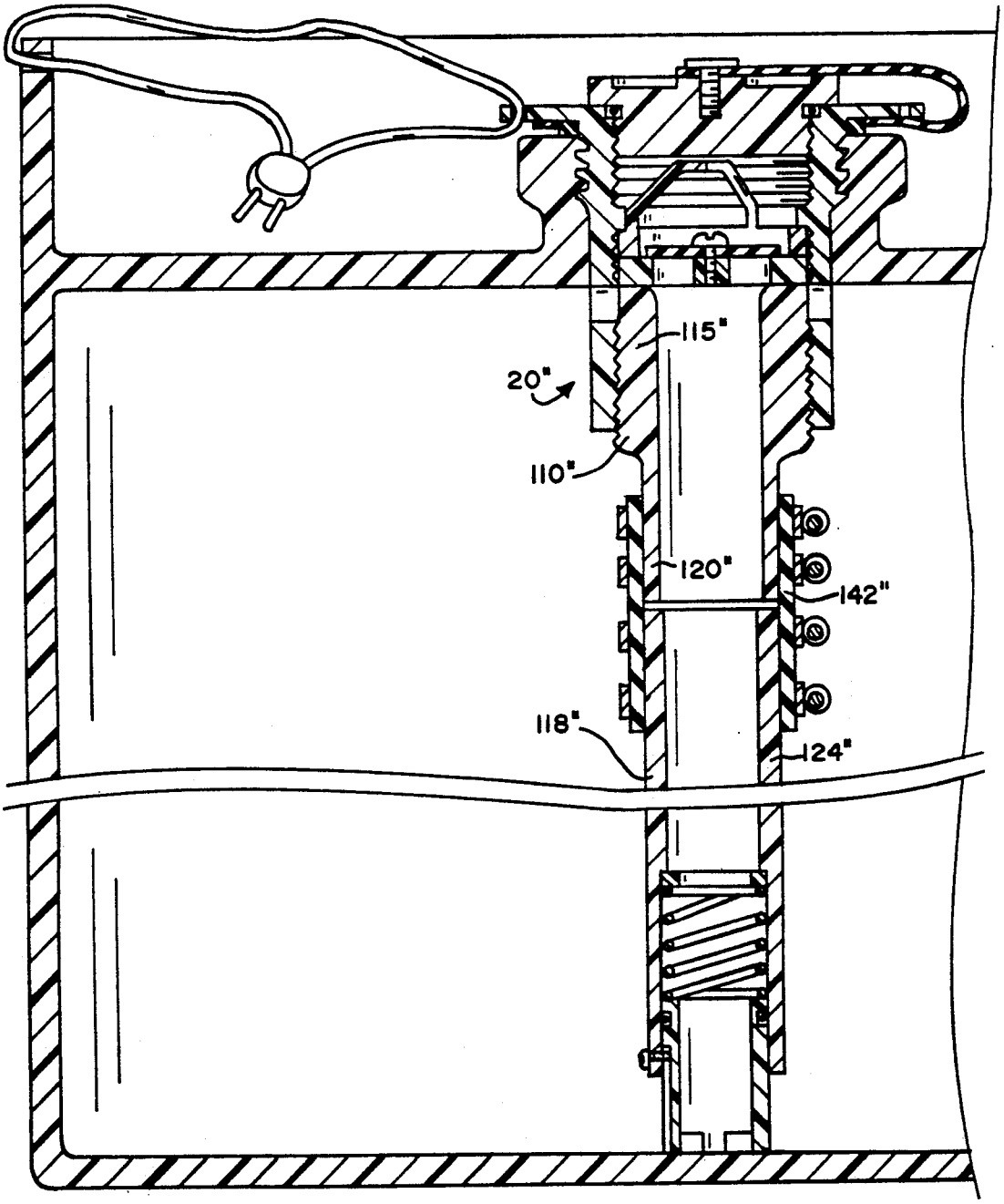
FIG. 6 is a sectional view similar to FIG. 1 showing an alternate embodiment of the present invention attached to a smaller dip tube.

In a variation 20'' of the present invention, shown in FIG. 6 and similar to the configuration shown in FIG. 1, lower portion 120'' of tube 110'' to which dip tube means 118'' is attached is reduced in outer diameter relative to upper portion 115'' of tube 110'', allowing a smaller diameter dip tube body 124'' and rubber sleeve 142'' to be used to reduce cost in applications where the wide diameter of dip tube means 118, shown in FIG. 1, is not required.

The present invention is usable in two configurations, one, a pumping condition, shown in FIGS. 1 and 6, in which tube 110 (or 110'') is removably received in lower end 30 of housing 22 and has a solid cylindrical tube wall 116 for blocking the flow of liquid through first drain hole means 26, and in which dip tube means 118 may be attached to tube 110 (or 110'') in a manner previously described, allowing liquid to be pumped from the interior I of container C through dip tube means 118, and out upper end 28 when cap 58 is removed therefrom and a fitting pipe, attached to a pump, is inserted instead therein as previously described. The relatively large bore of tube 110 and housing 22, and similarly large holes 44 in valve means 24, allow a high flow rate of liquid through fitting 20. In configurations where high flow rate of liquid is not required, it shall be understood that guard means 92 may be of a flatter design, with smaller openings 106 between fingers 98 or a greater multiplicity of fingers 98, thereby providing increased protection and guarding of valve means 24 at the sacrifice of some rate of flow of liquid therethrough.

In a second configuration, a gravity drain condition shown in FIG. 2, fitting 20 is inserted through wall W of an inverted container C, allowing gravity drain of liquid L from the interior I of container C. In this configuration, tube 110' will have a cylindrical wall 116' with second drain hole means 146 therethrough, as previously described, for allowing the residual amounts of liquid L to be drained from the interior I of container C through first and second drain hole means 26, 146 as previously described.

It can thus be seen that by having the aforementioned tube be selected from the group consisting of a first tube 110 having a solid cylindrical wall 116, and a second tube 110' having a cylindrical wall 116', said second tube 110' including second drain hole means 146 through cylindrical wall 116', for draining the interior I of container C when in alignment with first drain hole means 26, that two configurations of fitting 20 may be created with most parts of each configuration being identical, thereby reducing inventory stocking requirements.

Some of the advantages resulting from the invention described above are as follows:

(1) The fitting 20 is simple and can allow a high flow rate of liquid therethrough;

(2) The fitting 20 allows the draining of residual amounts of liquid from within a container when in the gravity drain condition;

(3) The fitting 20 allows the pumping of liquid from within a container when in the pumping condition;

(4) The fitting 20 is of a low profile design, has a low stacking height, and does not interfere with the stacking of containers one upon another;

(5) The fitting 20 provides evidence of tampering or removal of the fitting from a container;

(6) The fitting 20 has a one-way valve means which is removable for cleaning or repair, and (7) The fitting 20 allows only a one-way flow of liquid from within a container.

Having described the invention, what is claimed is:

1. A fitting for use in dispensing liquid from a container having a container wall, an interior, and an opening through said container wall communicating with said interior of said container, said fitting comprising:

(a) a housing having an open upper end, an open lower end, and a housing wall defining a passageway communicating said open upper end with said open lower end, said housing including means for mounting said housing in said opening in said container with said open upper end of said housing extending to the outside of said container and with said open lower end of said housing being in communication with said interior of said container;

(b) valve means disposed in said housing for blocking flow of liquid through said housing in a direction towards said open lower end and for permitting flow of liquid in the opposite direction towards said open upper end; and (c) first drain hole means through said housing wall in communication with said passageway and for being in communication with said interior of said container for draining the interior of said container through said passageway.

2. The fitting of claim 1 which includes a cap having external threads, and in which said housing has internal threads in said upper end thereof for selectively threadedly receiving said cap or a fitting pipe having external threads of the same size as said external threads of said cap.

3. The fitting of claim 2 which includes strap means for attaching said cap to said housing, said container including a lip extending above said container wall, said strap means including a rivet attaching said strap means to said cap and in which the height of said cap and said strap means above said container wall, when said housing is mounted in said opening in said container, is less than the height of said lip.

4. The fitting of claim 1 which includes a tube removably received in said lower end of said housing for removably holding said valve means in place in said housing.

5. The fitting of claim 4 which in which said tube includes a cylindrical wall and includes second drain hole means through said cylindrical wall of said tube in alignment with said first drain hole means for draining said interior of said container through said first drain hole means, said second drain hole means and said passageway.

6. The fitting of claim 4 in which said tube includes a solid cylindrical wall and in which is included dip tube means fixedly attached to said tube for extending to a position adjacent the lowermost portion of said container and for permitting pumping of liquid from the interior of said container.

7. The fitting of claim 6 in which said tube includes a lower portion to which said dip tube means is attached and an upper portion, said lower portion being reduced in outer diameter relative to said upper portion.

8. The fitting of claim 1 which includes guard means in said housing above said valve means for preventing tampering with said valve means.

9. The fitting of claim 8 in which said guard means includes a base ring and a plurality of fingers respectively having upper ends and lower ends, said fingers being respectively fixedly attached to said base ring at said lower ends of said fingers, said fingers extending upwardly and inwardly towards one another and being fixedly joined together at said upper ends thereof, said fingers being spaced apart along major portions of the lengths thereof to provide openings for the flow of liquid therethrough.

10. A fitting for selective use to drain liquid by gravity from a container when in a gravity drain condition or to pump liquid from a container when in a pumping condition, said container having a container wall, an interior, and an opening through said container wall communicating with said interior of said container, said fitting comprising:

(a) a housing having an open upper end, an open lower end, and a housing wall defining a passageway communicating said open upper end with said open lower end, said housing including means for mounting said housing in said opening in said container with said open upper end of said housing extending to the outside of said container and with said open lower end of said housing being in communication with said interior o said container;

(b) valve means disposed in said housing for blocking flow of liquid through said housing in a direction towards said open lower end and for permitting flow of liquid in the opposite direction towards said open upper end;

(c) first drain hole means through said housing wall for causing said passageway to be in communication with said interior of said container;

(d) a tube selected from the group consisting of:

i. a first tube including a solid first tube wall, and ii. a second tube including a second tube wall and second drain hole means through said second tube wall for draining said interior of said container through said first drain hole means, said second drain hole means, and said passageway when said second drain hole means is in alignment with said first drain hole means, said selected tube being removably received in said lower end of said housing for removably holding said valve means in place in said housing;

when in said pumping condition said first tube being selected and removably received in said lower end of said housing with said solid first tube wall blocking flow of liquid through said first drain hole means, and when in said gravity drain condition said second tube being selected and removably received in said lower end of said housing with said second drain hole means being in said alignment with said first drain hole means.

11. The fitting of claim 10 which includes guard means in said housing above said valve means for preventing tampering with said valve means.

12. The fitting of claim 11 which includes tamper resistant lock means attaching said housing to said container for preventing unwanted removal of said housing from said container.

13. The fitting of claim 12 in which said guard means includes a base ring and a plurality of fingers respectively having upper ends and lower ends, said fingers being respectively fixedly attached in spaced apart relationship to said base ring at said lower ends of said fingers, said fingers extending upwardly and inwardly towards one another and being fixedly joined together at said upper ends thereof, said fingers being spaced apart along major portions of the lengths thereof to provide openings for the flow of liquid therethrough.

14. A fitting for use in dispensing liquid from a container having a container wall, an interior, and an opening through said container wall communicating with said interior of said container, said fitting comprising:

(a) a housing having an open upper end, an open lower end, and a housing wall defining a passageway communicating said open upper end with said open lower end, said housing including means for mounting said housing in said opening in said container with said open upper end of said housing extending to the outside of said container and with said open lower end of said housing in communication with said interior of said container;

(b) valve means disposed in said housing for blocking flow of liquid through said housing in a direction towards said open lower end and permitting flow of liquid in the opposite direction towards said open upper end;

(c) first drain hole means through said housing wall in communication with said passageway and for being in communication with said interior of said container for draining the interior of said container through said passageway;

(d) a tube removably received in said lower end of said housing for removably holding said valve means in place in said housing; and (e) guard means in said housing above said valve means for preventing tampering with said valve means, said guard means including a base ring and a plurality of fingers respectively having upper ends and lower ends, said fingers being respectively fixedly attached to said base ring at said lower ends of said fingers, said fingers extending upwardly and inwardly towards one another and being fixedly joined together at said upper ends thereof, said fingers being spaced apart along major portions of the lengths thereof to provide openings for the flow of liquid therethrough.

15. The fitting of claim 14 in which said tube includes a cylindrical wall and includes second drain hole means through said cylindrical wall of said tube in alignment with said first drain hole means for draining said interior of said container through said first drain hole means, said second drain hole means and said passageway.

16. The fitting of claim 14 in which said tube includes a solid cylindrical wall and in which is included dip tube means fixedly attached to said tube for extending to a position adjacent the lowermost portion of said container and for permitting pumping of liquid from the interior of said container.

* * * * *